US005672835A

United States Patent [19]

Doughty

[11] Patent Number: 5,672,835

[45] Date of Patent: Sep. 30, 1997

[54] TREMOLO DEVICES

[76] Inventor: Colin David Doughty, 140 Wellington Road, Wainuiomata, Wellington, New Zealand

[21] Appl. No.: 519,166

[22] Filed: Aug. 25, 1995

[51] Int. Cl.[6] ..... G10D 3/00

[52] U.S. Cl. ..... 84/313

[58] Field of Search ..... 84/313, 297 R, 84/298, 307

[56] References Cited

U.S. PATENT DOCUMENTS

| | | | |
|---|---|---|---|
| 3,466,962 | 9/1969 | Cole | 84/313 |
| 4,171,661 | 10/1979 | Rose | 84/313 |
| 4,285,262 | 8/1981 | Scholz | 84/313 |
| 4,487,100 | 12/1984 | Storey | 84/313 |
| 4,555,970 | 12/1985 | Rose | 84/313 |
| 4,674,389 | 6/1987 | Fender | 84/313 |
| 4,843,941 | 7/1989 | Nichols et al. | 84/313 |
| 4,939,971 | 7/1990 | Satoh | 84/313 |
| 5,419,227 | 5/1995 | Lavineway | 84/313 |

*Primary Examiner*—Cassandra C. Spyrou
*Attorney, Agent, or Firm*—Jacobson, Price, Holman & Stern, PLLC

[57] ABSTRACT

A tremolo device for an electric guitar consists of pivotal upper and lower plates with fulcrums. The upper plate holds the ends of the guitar strings. The tremolo arm is on the upper plate. There is a relative angle limiting means between the upper and lower plates. A spring urges the second plate into a stopped position against the guitar body. The arrangement of the device is such that in a neutral position the tremolo is locked rather than floating. The tremolo device has a large arc of travel but at the same time is highly sensitive.

15 Claims, 5 Drawing Sheets

TREMOLO DEVICES

FIELD OF INVENTION

This invention relates to a tremolo device. More particularly it relates to a tremolo device for use on electric guitars to enable a precise return to the in-tune position of the guitar strings after the tremolo device has been used.

BACKGROUND TO THE INVENTION

In conventional tremolo devices mounted on guitars the device is in a "floating" condition about a fulcrum during which an equilibrium is maintained between the tension of the spring or springs on the tremolo device and the strings of the guitar. As a result there may be deviations in tuning when the guitar is played in the normal condition. In addition, if a string is broken the remaining guitar strings may be out of tune.

It is an object of this invention to go some way towards overcoming these disadvantages or at least to offer the public a useful choice.

SUMMARY OF THE INVENTION

Accordingly the invention may be said broadly to consist in a tremolo device for fitment in a guitar body of a guitar having a body, neck and head, the device comprising:

an upper plate pivotal about a first pivot point mountable on a said guitar body, said upper plate having retaining means at or near the trailing edge of said upper plate in the direction of said guitar head for releasably retaining an end of each of the strings of said guitar, said strings in use pivoting said upper plate upwardly, a lower plate pivotal about a second pivot point, said second pivot point being mountable either on said guitar body or on said upper plate, a tremolo arm mounted in said upper plate so as to be able to pivot said upper plate about said first pivot point, limiting means operable between said upper plate and said lower plate limiting the relative angle of pivot between said upper and lower plates, first spring means on said second plate mountable in said guitar body to urge said second plate downwardly into a stopped position relative to said guitar body, the arrangement of construction being such that in use said tremolo device is fitted to a said guitar body and strings are mounted thereon whereby:

a) when said tremolo device is in a neutral position, said lower plate is retained in said stopped position by said first spring means and said upper plate is retained at a maximum said relative angle of pivot from said lower plate by the tension in said guitar strings and by said limiting means;

b) when said tremolo device is pivoted in a first direction from said neutral position, said upper and lower plates pivot upwardly while maintaining said maximum relative angle of pivot from each other; and, c) when said tremolo device is pivoted in a second opposite direction from said neutral position, said lower plate remains in said stopped position and said upper plate pivots downwardly reducing said relative angle of pivot between said upper and lower plates.

Preferably said second pivot point is positioned so that said lower plate pivots about the same axis of pivot as said upper plate.

Preferably said second pivot point is mounted in said upper plate.

In one alternative first pivot point is a fulcrum and said upper plate has a knife-edge at the leading edge of said upper plate in the direction of said guitar head, said knife-edge abutting said fulcrum.

In another alternative said first pivot point is a pin mounted at its ends on said guitar body and at the centre in said upper plate.

In one embodiment said second pivot point is a fulcrum and said lower plate has a knife-edge at the leading edge of said lower plate in the direction of said guitar head, said knife-edge abutting said fulcrum.

In another alternative said second pivot point is a pin mounted at its ends on said upper plate and at the centre in said lower plate.

Preferably there is a second spring means joining a point near the trailing edge of said upper plate with a corresponding point near the trailing edge of said lower plate, said second spring means urging said upper and lower plates together.

Preferably the tension in said second spring means is adjustable.

Preferably said first and second spring means are both coil springs.

Preferably said limiting means limits the maximum said relative pivotal angle between said first and second plates.

More preferably said limiting means limits both the maximum and minimum said relative angles.

Alternatively said limiting means includes means for maintaining a fixed relative pivoting angle between said upper plate and said lower plate.

In another embodiment the invention may be said broadly to consist in a guitar and a tremolo device as defined above.

BRIEF DESCRIPTION OF THE DRAWINGS

The invention may be more fully understood by having reference to the accompanying drawings in which.

DETAILED DESCRIPTION OF THE DRAWINGS

CONSTRUCTION OF FIRST EMBODIMENT

Figure 1:
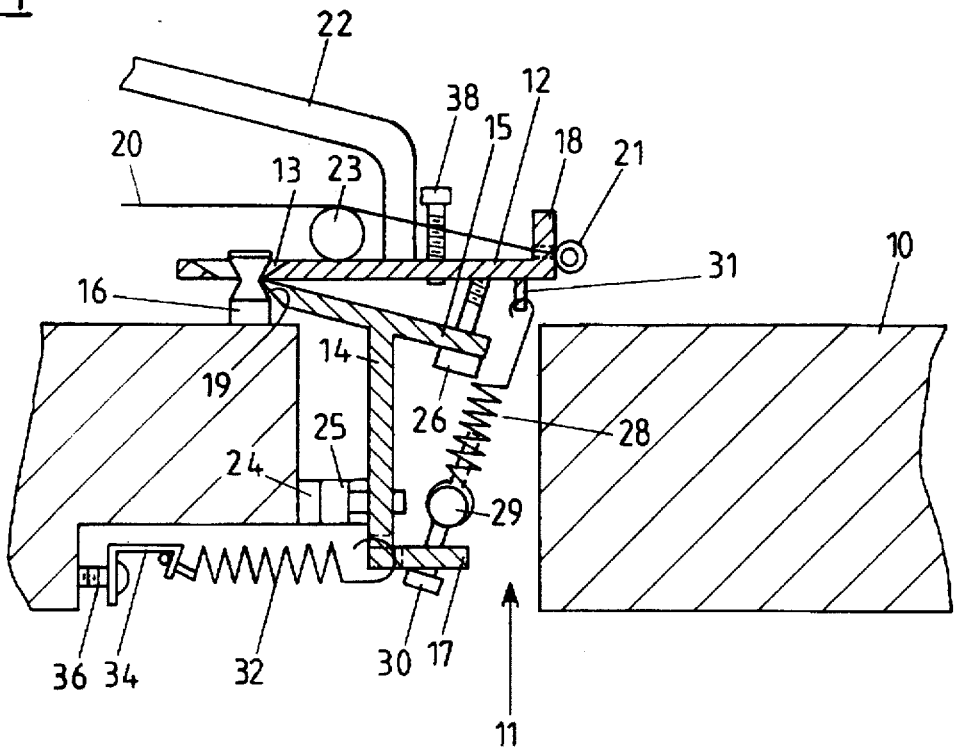
FIG. 1 is a sectional view along the line A—A in FIG. 4 of a first embodiment of the invention where the tremolo device is in a neutral position.

The tremolo device according to the first embodiment of the invention may be mounted in an electric guitar of the type illustrated in U.S. Pat. Nos. 4,171,661 and 4,843,941. Such a guitar consists of a guitar body, a neck and a head. The strings are mounted at one end on a bridge in the body and extend over the saddles along the neck over the nut to the machine heads. Strings are tuned by machine heads in the guitar head.

In FIGS. 1 to 4 the tremolo device is designed to be fitted into the opening 11 of a guitar body 10. The opening 11 is standard to most electric guitars. The tremolo device of the invention can be fitted to an original guitar or retro-fitted to an existing guitar.

The tremolo device consists of an upper plate 12 and a lower plate 14. A pair of fulcrums 16 as illustrated are mounted in the guitar body 10. A knife-edge 13 forming a portion of a hole cut through upper plate 12 provides a pair of pivoting leading edges for upper plate 12. As can be seen from FIG. 4 a pair of fulcrums 27 extend downwardly from the bottom face of upper plate 12 to form a second fulcrum against which the knife-edge 19 at the leading edge of lower plate 14 pivots. The axis of pivot of both upper and lower plates 12 and 14 is substantially the same in the embodiment illustrated although this is not essential.

Figure 5:
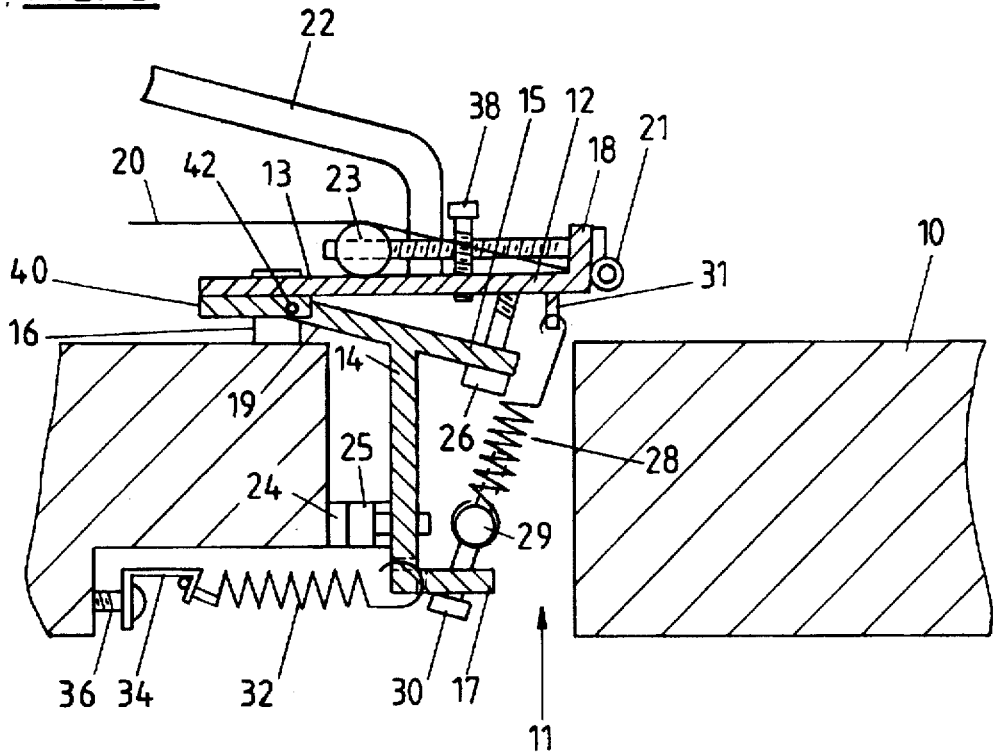
FIG. 5 is a sectional view along the line B—B in FIG. 8 of a first embodiment of the invention where the tremolo device is in a neutral position.
Figure 6:
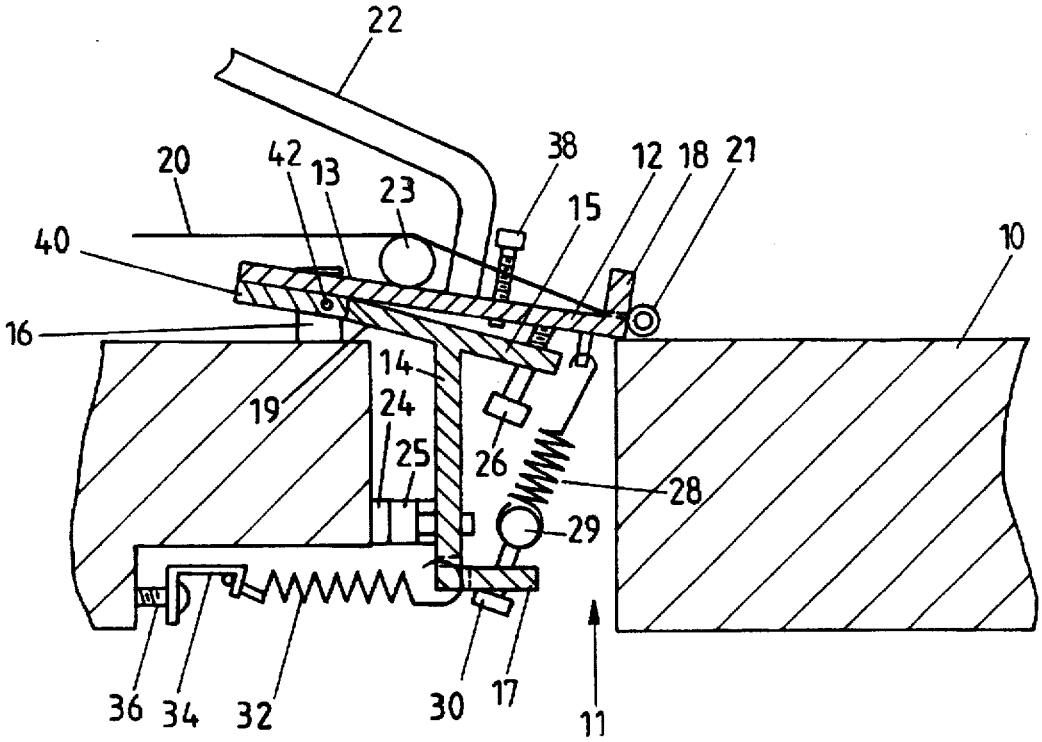
FIG. 6 is the same sectional view as FIG. 5 with the tremolo device pivoted to a first position in which the strings are sharp relative to the aforesaid neutral position.
Figure 9:
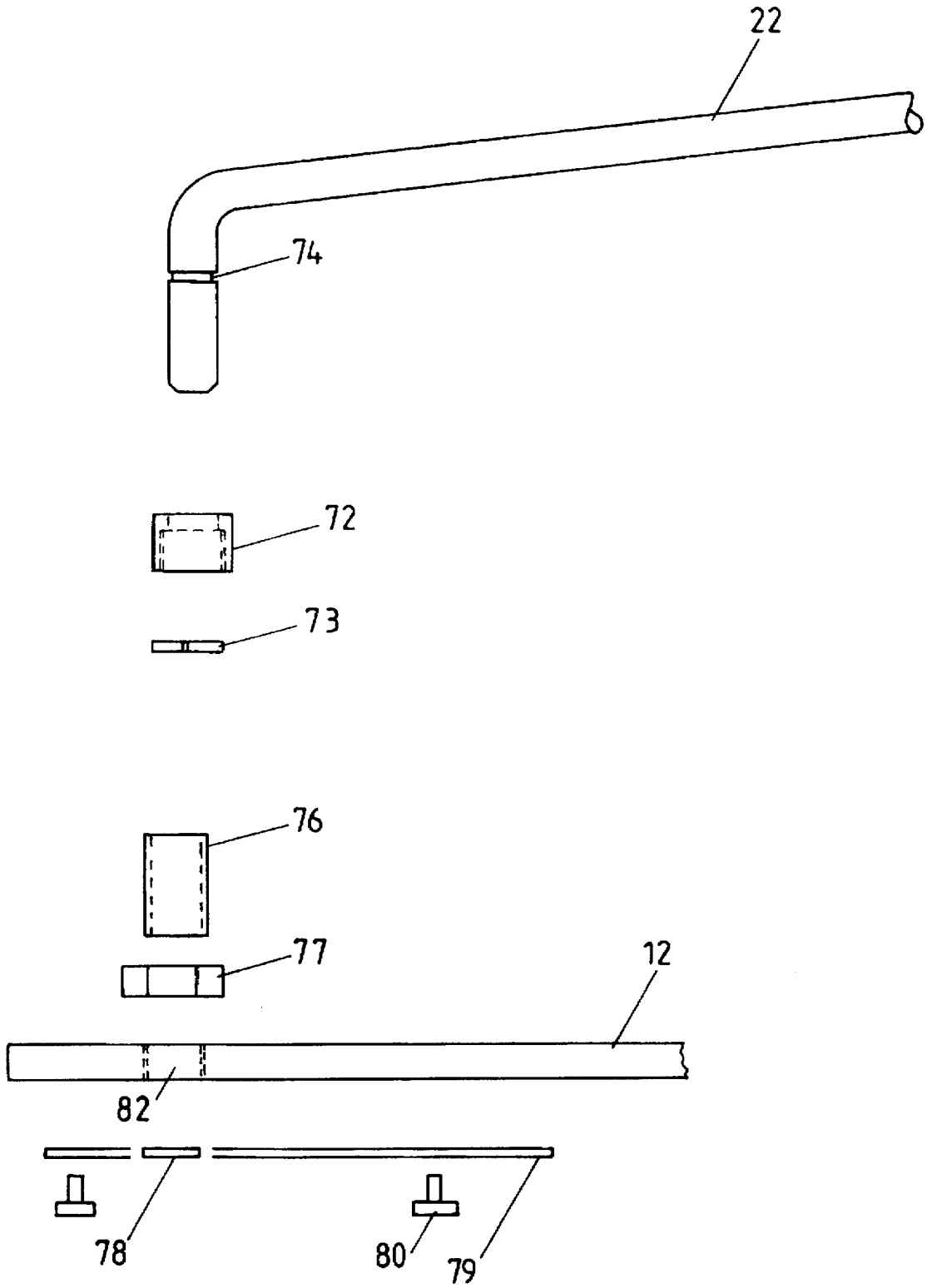
FIG. 9 is a side elevational exploded view of the mechanism for fitting handle 22 to upper plate 12.
Figure 7:
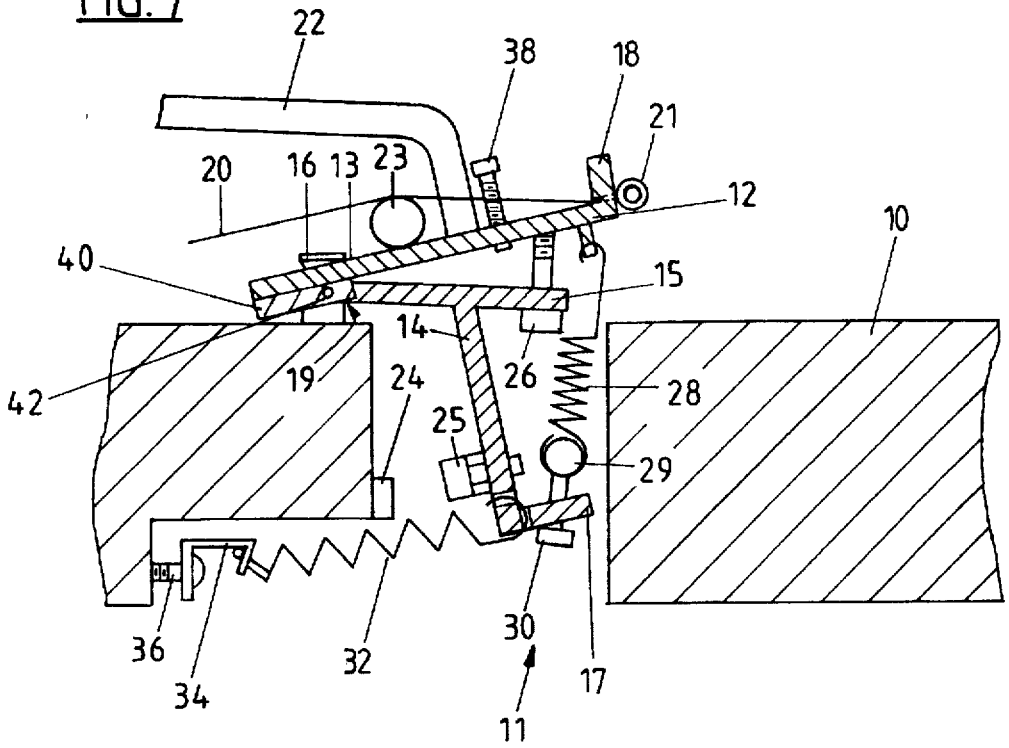
FIG. 7 is the sectional view as FIG. 5 with the tremolo device pivoted to a second position in which the strings are flat relative to the aforesaid neutral position.
Figure 8:
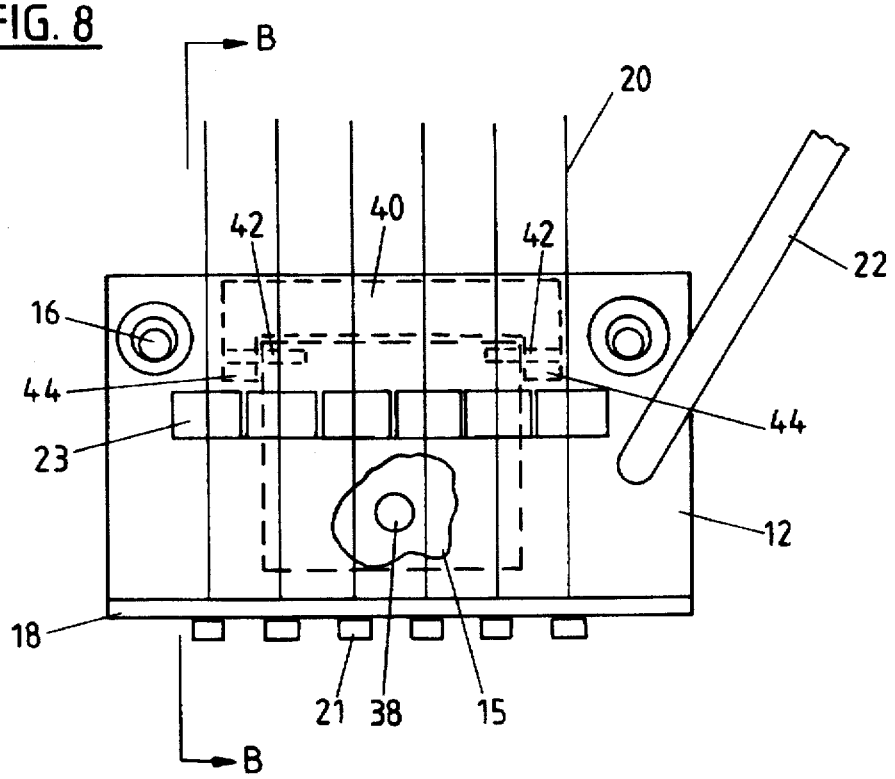
FIG. 8 is a top plan view of the embodiment illustrated in FIGS. 5 to 7.

Strings 20 pass through holes in extension 18. An end piece 21 at the end of each of the strings 20 allows the strings to be retained in position. Saddles 23 extend across plate 12 and the strings 20 rest in the appropriate indentations in the saddles. The position of saddles 23 is adjustable by means of screws 23*a*, one of which is shown in FIG. 5. Screws 23*a* pass through threaded holes in extension 18.

Tremolo arm 22 fits into upper plate 12 in a manner known in the art or preferably as described below with reference to FIG. 12. There are provided limiting means to limit the relative angle of pivot between upper plate 12 and lower plate 14. The first of these is adjustable screw 38 which is illustrated in its retracted position in each of FIGS. 1, 2 and 3. The second component of the limiting device is an adjustable screw 26 which is threaded into a threaded bore in plate 12. Screw 26 passes through an opening in extension 15 of lower plate 14.

Starting from knife-edge 19, lower plate 14 extends downwardly in opening 11. It is provided with a stop means 25 which is designed to abut shock absorber 24 which is mounted on the guitar body 10 as illustrated. At the bottom of bottom plate 14 there are openings into which the ends of coil springs 32 are attached. The other ends of coil springs 32 are mounted on a bracket 34 which is held in the body 10 of the guitar by screw 36. An extension 17 extends away from springs 32 at right angles to the main portion of lower plate 14. A screw 30 passes through a threaded bore in extension 17. Screw 30 also passes through a bore in a cross member 29. Second coil springs 28 are mounted at one end to cross-member 29 and at the other end to a hook 31 on the bottom of upper plate 12.

The mechanism for attaching tremolo arm 22 to upper plate 12 is illustrated in FIG. 12. The components from the top are the tremolo arm 22 having a groove 74, a connecting nut 72 and a thrust split washer 73. A threaded nipple 76 fits into threaded bore 82 in upper plate 12. Locking nut 77 holds nipple 76 in place. Holding screws 80 hold stainless steel spring plate 79 in position below upper plate 12. To assemble the arm 22 is passed through the nut 72 and expanded split washer 73. Split washer 73 is crimped into grove 74. Nipple 76 is threaded into bore 82 and secured by locking nut 77. Assembled arm 22 is lowered into the centre of nipple 76 and the assembly completed by screwing locking nut 72 onto nipple 76.

The secured end of arm 22 protrudes just below bush 74 and contacts the tongue 78 of plate 79. The secured end of arm 22 is slightly longer than nipple 76. This allows some adjustment of nut 72 giving a firm but free movement of handle 22.

OPERATION OF THE FIRST EMBODIMENT

Figure 2:
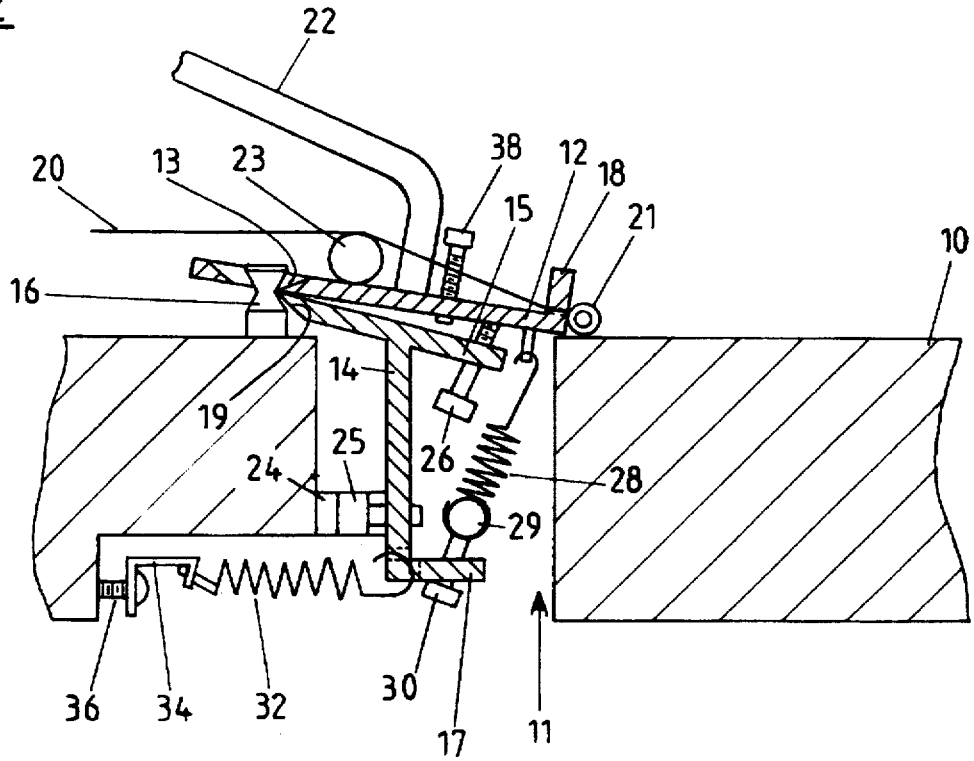
FIG. 2 is the same sectional view as FIG. 1 with the tremolo device pivoted to a first position in which the strings are sharp relative to the aforesaid neutral position.
Figure 3:
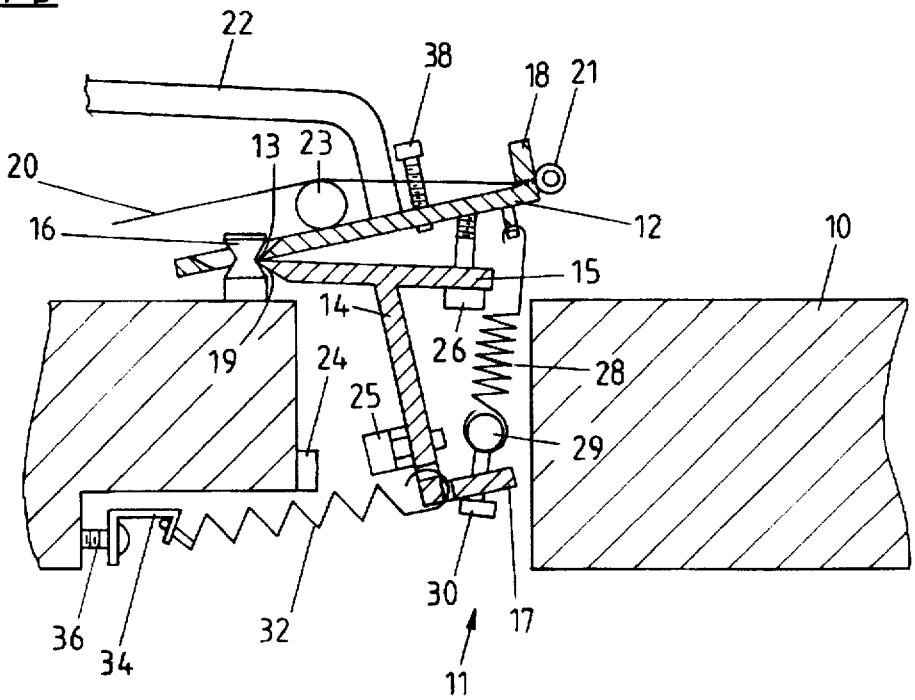
FIG. 3 is the sectional view shown in FIG. 1 with the tremolo device pivoted to a second position in which the strings are flat relative to the aforesaid neutral position.
Figure 4:
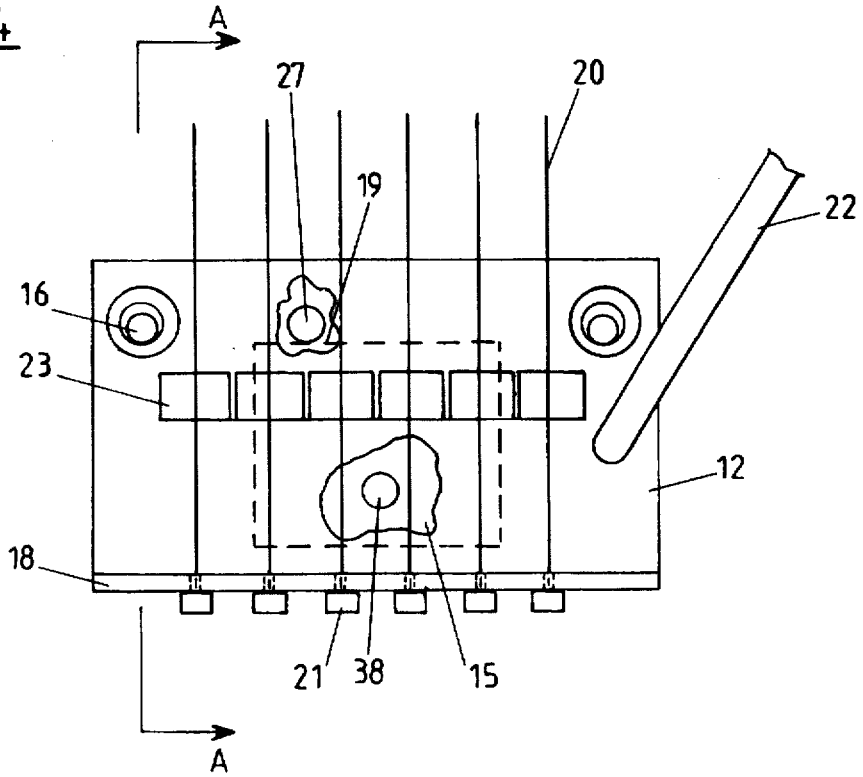
FIG. 4 is a top plan view of the embodiment illustrated in FIGS. 1 to 3.

In order to tune the guitar the tremolo device is in the neutral position illustrated in FIGS. 1 to 3. Locking screw 38 can be wound into upper plate until the end of it is against the upper surface of extension 15 of second plate 14. In this position limiting screw 26 is against the bottom of extension 15. If the tremolo arm were accidentally lifted the tremolo device would not move because it is locked in position. The strings are then tuned in a conventional manner using the tuning machine heads in the head of the guitar. Once the guitar is tuned screw 38 of the tremolo device is released and the guitar is ready to be played. When the tremolo arm is left alone the guitar may be played in the configuration illustrated in FIG. 1. The neutral position illustrated is not a "floating" position but rather one in which the tension in springs 32 exceeds the tension in the guitar strings 20 so that the lower plate 14 remains at rest against stop 24. The tension in strings 20 also exceeds the tension in springs 28 so that limiting screw 26 rests against the bottom of extension 15. Thus the tremolo is in a relatively fixed position.

When the guitar player wishes to pivot the tremolo so that the strings are sharp relative to the neutral position he lifts the tremolo arm 22 as illustrated in FIG. 2. This pivots the first plate 12 downwardly assisted by the tension in springs 28. In the embodiment illustrated plate 12 extends rearwardly beyond the edge of opening 11 so that the guitar body 10 acts as a stop limiting the amount of travel of upper plate 12. Alternatively screw 38 can be adjusted downwardly so as to create a stop against the top of lower plate 14 short of this position. Screw 26 extends freely through the opening in extension 15 of lower plate 14 to allow pivoting of upper plate 12. In a further alternative upper plate 12 can be positioned so as to pass into opening 11 so that upper plate 12 could pivot until stopped by contact with the top of lower plate 14.

Among the advantages of this invention are that the amount of tremolo can be adjusted more sensitively than with conventional tremolo devices. Also the device allows for greater travel of the tremolo device and thus an increase in the variation of pitch can be achieved. The tremolo device may also be maintained in a fixed neutral position rather than in a floating neutral position with all of its disadvantages.

CONSTRUCTION OF SECOND EMBODIMENT

The second embodiment illustrated in FIGS. 5 to 8 is almost identical in its construction to the first embodiment in FIGS. 1 to 4. Where the same components are used reference numbers are the same. The only difference in construction is the use of pins as pivots instead of fulcrums and knife-edges.

In the second embodiment a bracket 40 with two pin receiving arms 44 is fixed to the bottom of upper plate 12 by an appropriate fixing means such as screws. Needle bearings 42 are provided to act as pivoting pins. They are mounted in bores in each of the bracket arms 44 and the side edges of lower plate 14. In the second embodiment illustrated the pivot point for the upper plate 12 is knife-edge 13 abutting against fulcrum 16.

Alternatively in addition to having the lower plate 14 pivot about pin 42 there can also be provided a similar pin and bracket arrangement with the necessary adjustments for pivoting upper plate 12.

OPERATION OF SECOND EMBODIMENT

The second embodiment operates in the same manner as the first embodiment as described above.

The invention has been described in relation to preferred embodiments as defined in the statements of invention. Other permutations and combinations within the scope of the invention will be apparent to those skilled in the art.

What is claimed is:

1. A tremolo device for a guitar having a body, neck, strings and head, the device comprising:

an upper plate having a leading edge toward said head and a trailing edge away from said head pivotal about a first pivot point, said first pivot point being mountable on said guitar body, said upper plate having a retaining means at or near said trailing edge of said upper plate for releasably retaining an end of each of the strings of said guitar whereby said strings pivot said upper plate upwardly, a lower plate having a leading edge toward said head and a trailing edge away from said head pivotal about a second pivot point, said second pivot point being mountable either on said guitar body or on said upper plate, said upper plate having a lowermost plane, said lower plate having an uppermost plane, said lowermost plane of said upper plate intersecting with said uppermost plane of said lower plate to form a relative angle of pivot therebetween, a tremolo arm mounted in said upper plate so as to be able to pivot said upper plate about said first pivot point, limiting means operable between said upper plate and said lower plate to limit the relative angle of pivot between said upper and lower plates, first spring means on said lower plate and mountable in said guitar body to urge said lower plate downwardly into a stopped position relative to said guitar body, said tremolo device being adapted to be fitted to said guitar body with said strings mounted thereon whereby:

a) when said tremolo device is in a neutral position, said lower plate is retained in said stopped position by said first spring means and said upper plate is retained by tension in said guitar strings and by said limiting means so that said relative angle of pivot is at a maximum limit.

b) when said tremolo device is pivoted in a first direction from said neutral position, said upper and lower plates pivot upwardly while said relative angle of pivot remains at said maximum limit; and c) when said tremolo device is pivoted in a second opposite direction from said neutral position, said lower plate remains in said stopped position and said upper plate pivots downwardly thereby reducing said relative angle of pivot.

2. A tremolo device as claimed in claim 1 wherein said second pivot point is positioned so that said lower plate pivots about the same axis of pivot as said upper plate.

3. A tremolo device as claimed in claim 2 wherein said second pivot point is mounted in said upper plate.

4. A tremolo device as claimed in claim 1 wherein said first pivot point is a fulcrum and said upper plate has a knife-edge at said leading edge of said upper plate, said knife-edge abutting said fulcrum.

5. A tremolo device as claimed in claim 4 wherein said second pivot point comprises a pair of pins mounted on each of said upper plate and said lower plate.

6. A tremolo device as claimed in claim 1 wherein said first pivot point comprises a pair of pins mounted on each of said guitar body and said upper plate.

7. A tremolo device as claimed in claim 6 wherein said second pivot point is a fulcrum and said lower plate has a knife-edge at said leading edge of said lower plate, said knife-edge abutting said fulcrum.

8. A tremolo device as claimed in claim 1 wherein said second pivot point is a fulcrum and said lower plate has a knife-edge at said leading edge of said lower plate, said knife-edge of said lower plate abutting said fulcrum of said second pivot point.

9. A tremolo device as claimed in claim 8 wherein said first pivot point is a fulcrum and said upper plate has a knife-edge at said leading edge of said upper plate, said knife-edge of said upper plate abutting said fulcrum of said first pivot point.

10. A tremolo device as claimed in claim 1 wherein said second pivot point comprises a pair of pins mounted on each of said upper plate and said lower plate.

11. A tremolo device as claimed in claim 10 wherein said first pivot point comprises a pair of pins mounted on each of said guitar body and said upper plate.

12. A tremolo device as claimed in claim 1 wherein there is a second spring means joining a point near said trailing edge of said upper plate with a corresponding point near said trailing edge of said lower plate, said second spring means urging said upper and lower plates together.

13. A tremolo device according to claim 12 wherein the tension in said second spring means is adjustable.

14. A tremolo device according to claim 12 wherein said first and second spring means are both coil springs.

15. A tremolo device according to claim 1 wherein said limiting means includes means for maintaining said relative pivoting angle at a fixed angle.

* * * * *